US008177388B2

(12) United States Patent
Yen

(10) Patent No.: US 8,177,388 B2
(45) Date of Patent: May 15, 2012

(54) LED TUBE STRUCTURE CAPABLE OF CHANGING ILLUMINATION DIRECTION

(76) Inventor: Hsu Li Yen, Taipei County (TW)

( * ) Notice: Subject to any disclaimer, the term of this patent is extended or adjusted under 35 U.S.C. 154(b) by 0 days.

(21) Appl. No.: 12/850,861

(22) Filed: Aug. 5, 2010

(65) Prior Publication Data

US 2012/0033417 A1 Feb. 9, 2012

(51) Int. Cl.
*F21S 4/00* (2006.01)

(52) U.S. Cl. ..... 362/217.01; 362/249.02; 362/249.11; 362/222; 362/221; 362/225

(58) Field of Classification Search ..... 362/217.01, 362/221, 222, 249.02, 249.11
See application file for complete search history.

(56) References Cited

U.S. PATENT DOCUMENTS

| | | | | |
|---|---|---|---|---|
| 7,549,778 | B2 * | 6/2009 | Chien | 362/396 |
| 7,562,998 | B1 * | 7/2009 | Yen | 362/219 |
| 7,635,201 | B2 * | 12/2009 | Deng | 362/249.02 |
| 2010/0124054 | A1 * | 5/2010 | Chen et al. | 362/221 |

* cited by examiner

*Primary Examiner* — Anabel Ton
(74) *Attorney, Agent, or Firm* — Rosenberg, Klein & Lee

(57) ABSTRACT

An improved LED tube structure capable of changing an illumination direction allows for use of a conventional fluorescent lamp holder and is capable of changing an illumination direction. The LED tube structure includes a transparent tube having a plug track disposed on an inner tube wall thereof, wherein the plug track is disposed approximate to or above a horizontal center line of the transparent tube, and the plug track is adapted for an LED lamp strip to be plugged therein; a conductive terminal having a tandem piece between two terminals thereof; and a positioning enclosure having two terminal plugholes spaced apart disposed in the middle portion thereof for the terminals to be fixedly plugged therein. The plug track grooves are disposed at different angles for the plug track on the inner wall of the transparent tube to be selectively plugged therein.

4 Claims, 4 Drawing Sheets

LED TUBE STRUCTURE CAPABLE OF CHANGING ILLUMINATION DIRECTION

BACKGROUND OF THE INVENTION

1. Technical Field

The present invention relates to an improved LED tube structure capable of changing an illumination direction, which is for use in a lamp.

2. Description of Related Art

Nowadays, various lamps are used for illumination in the life space, and the lamps can be disposed at required positions of the space to change brightness of the space by means of light emitted therefrom, thereby to ensure good lighting conditions. Generally, tubular fluorescent lamps are most commonly used. The fluorescent lamp can emit bright light, but the frequency of the emitted light is less stable, which may have an adverse influence on eyesight health. Moreover, a problem of mercury pollution will occur when fluorescent lamps are manufactured and recycled.

As people's awareness of environmental protection is enhanced, conventional lamp bodies are gradually replaced with current LED tubes all over the world. The LED tubes completely obviate such problems related to environment pollution and hazards to human health and, moreover, save power substantially.

However, an LED lamp strip 10*a* of an LED tube 10 (as shown in FIG. 1) irradiates light from a single side (a conventional fluorescent lamp irradiates light within a 360-degree range), so light irradiation of the LED tube 10 is directional. The LED tube 10 is joined to a connecting receptacle 20 of a conventional fluorescent lamp holder in the way that terminals 101 at both sides of the LED tube 10 (as shown in FIG. 2) are firstly inserted into the connecting receptacle 20 at both sides of the fluorescent lamp to be preliminarily positioned, and then the LED tube 10 is rotated by an angle of about 90 degree so that the terminals 101 thereof are rotated to make contact with power contacts of the connecting receptacle 20 for positioning purpose. The conventional fluorescent lamp holder is generally disposed on a roof (as shown in FIG. 3), and the LED tube 10 can normally irradiate light downwards for illumination. However, if the conventional fluorescent lamp holder (as shown in FIG. 4) is fixed on a side wall, then the LED tube 10 will irradiate light in a lateral direction and cannot irradiate light downwards in a normal way.

In view of the problem of the irradiation direction of the LED lamp strip 10*a* of the LED tube 10 described above, the inventor has continuously tried to have the LED tube 10 change the illumination direction according to practical requirements and, through many researches and tests, eventually obtains an improved LED tube structure design.

BRIEF SUMMARY OF THE INVENTION

The present invention relates to an improved LED tube structure capable of changing an illumination direction, which LED tube structure allows for use of a conventional fluorescent lamp holder and is capable of changing an illumination direction. The LED tube structure mainly comprises: a transparent tube having a corresponding plug track disposed on an inner tube wall thereof, wherein the plug track is disposed on the inner wall of the transparent tube at a height that is approximate to or above a horizontal center line of the transparent tube, and the plug track is adapted for an LED lamp strip to be plugged therein; a conductive terminal being formed of a metal through stamping and having a tandem piece between two terminals thereof; and a positioning enclosure having two terminal plugholes spaced apart disposed in the middle portion thereof for the terminals to be fixedly plugged therein, wherein an inner surface of the positioning enclosure is formed with a circular groove and plug track grooves corresponding to the tube wall and the plug track of the transparent tube, and the plug track grooves are disposed at different angles for the plug track on the inner wall of the transparent tube to be selectively plugged therein, thereby achieving the objective of changing the illumination direction of the LED lamp strip of the LED tube.

BRIEF DESCRIPTION OF THE SEVERAL VIEWS OF THE DRAWINGS

The invention as well as a preferred mode of use and advantages thereof will be best understood by referring to the following detailed description of illustrative embodiments in conjunction with the accompanying drawings, wherein.

DETAILED DESCRIPTION OF THE INVENTION

Figure 1:
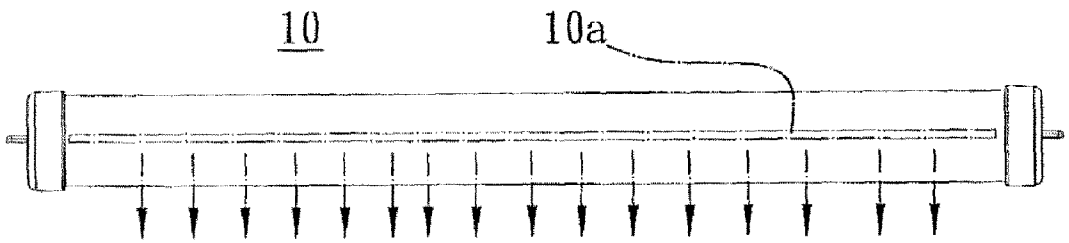
FIG. 1 is a schematic drawing showing that a conventional LED tube irradiates light from a single side.
Figure 3:
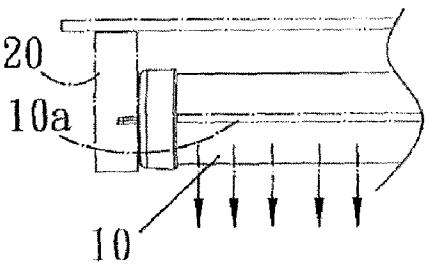
FIG. 3 is a schematic drawing showing that the conventional LED tube joined with the conventional fluorescent lamp holder illuminates downwards in a normal way.
Figure 4:
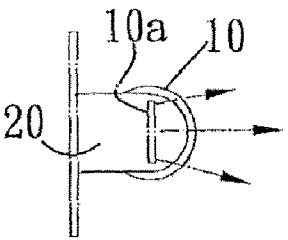
FIG. 4 (PRIOR ART)
FIG. 4 is a schematic drawing showing that the conventional LED tube joined with the conventional fluorescent lamp holder illuminates abnormally in a lateral direction.
Figure 2:
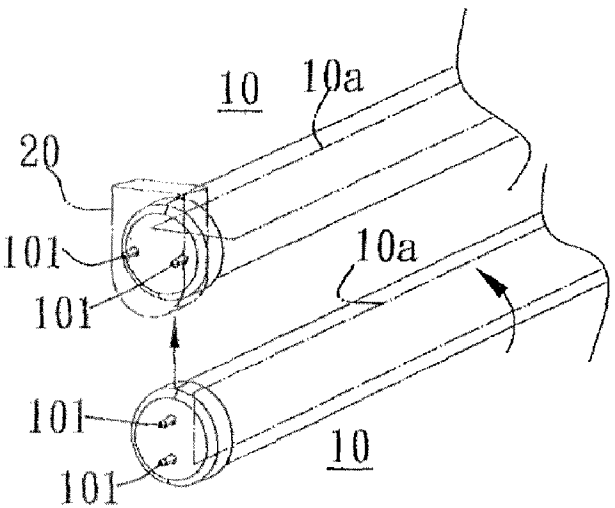
FIG. 2 is a schematic drawing showing an action of joining the conventional LED tube with a conventional fluorescent lamp holder.
Figures 5, 6, 7:
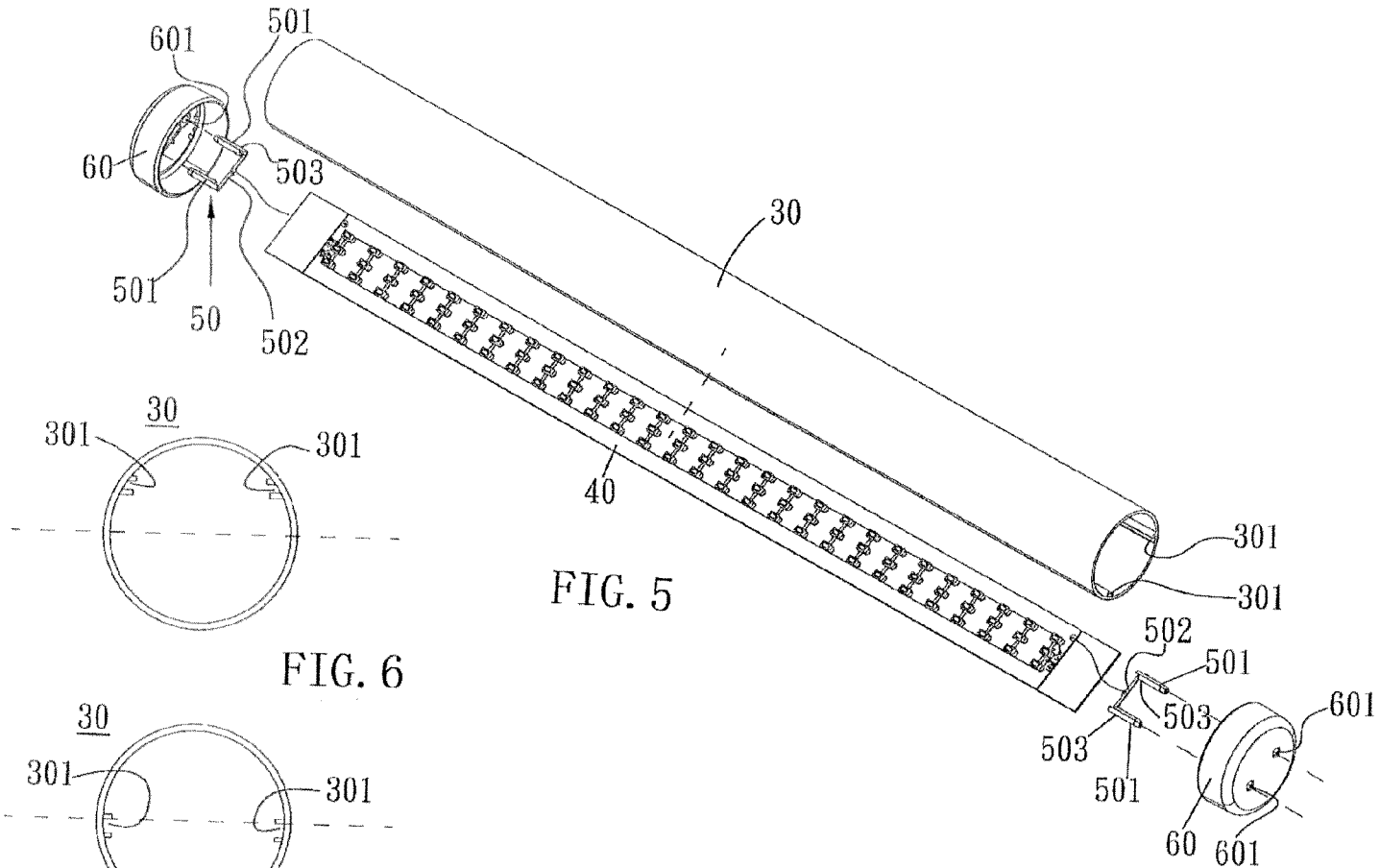
FIG. 5 is a perspective assembly view of an improved LED tube structure capable of changing an illumination direction according to the present invention.
FIG. 6 is a schematic view of a transparent tube of the present invention.
FIG. 7 is a schematic view of another embodiment of the transparent tube of the present invention.
Figure 8:
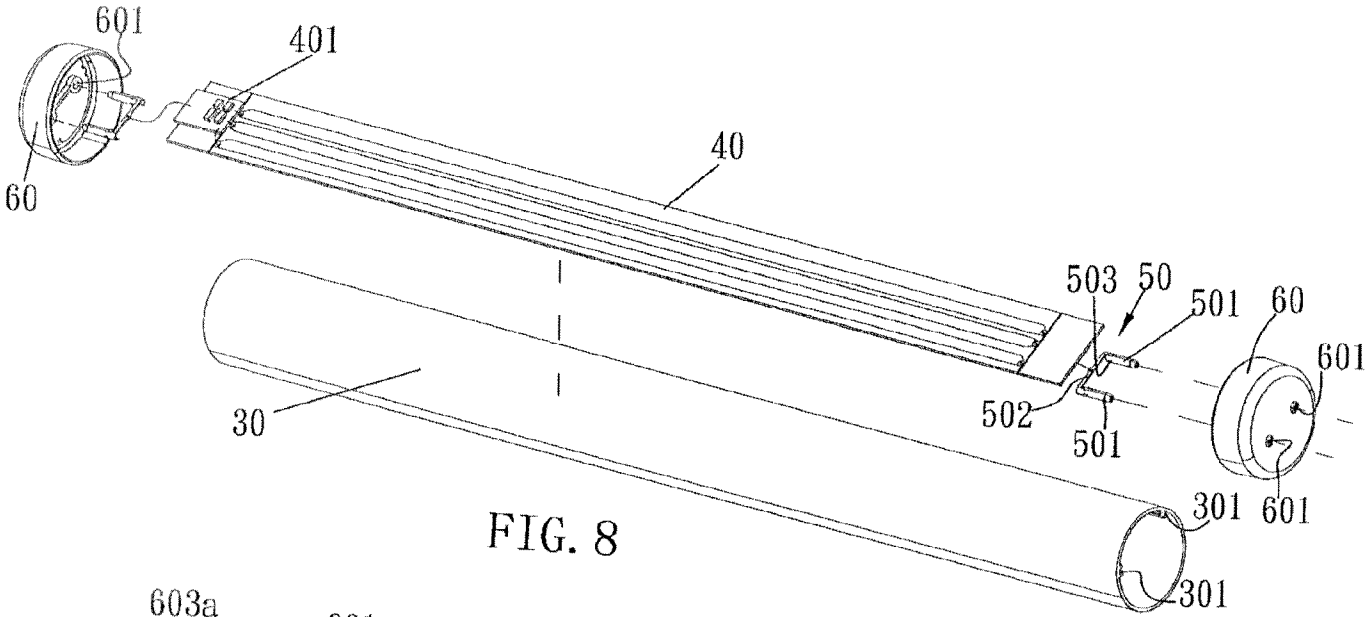
FIG. 8 is another perspective assembly view of an improved LED tube structure capable of changing an illumination direction according to the present invention.
Figure 10:
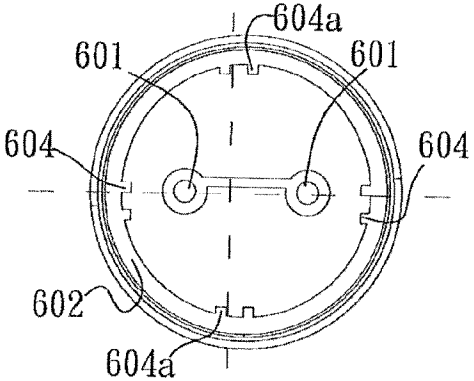
FIG. 10 is a schematic view of another embodiment of the positioning enclosure of the present invention.
Figure 9:
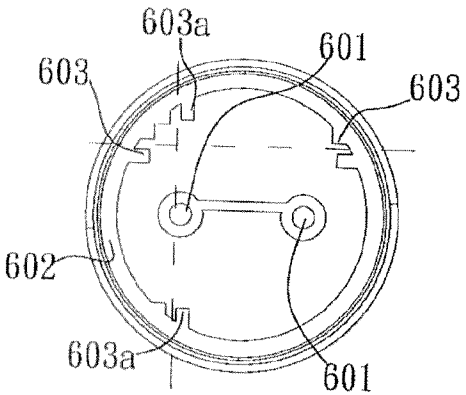
FIG. 9 is a schematic view of a positioning enclosure of the present invention.

FIG. 5 is a perspective assembly drawing showing an improved LED tube structure capable of changing an illumination direction according to the present invention. As shown in FIG. 5 (reference may also be made to FIG. 8), the LED tube structure comprises: a transparent tube 30 having a corresponding plug track 301 disposed on an inner tube wall thereof, wherein the plug track 301 is disposed on the inner wall of the transparent tube 30 at a height that is approximate to a horizontal center line (as shown in FIG. 6) of the transparent tube 30 or above the horizontal center line (as shown in FIG. 7), and the plug track 301 is adapted for an LED lamp strip 40 to be plugged and positioned therein; a conductive terminal 501 being formed of a metal through stamping and having a tandem piece 502 between two terminals 501 thereof, wherein both the terminals 501 are provided with a plurality of protruding hooks 503; and a positioning enclosure 60 (as shown in FIG. 9), having two terminal plugholes 601 spaced apart disposed in the middle portion thereof, wherein the protruding hooks 503 of the terminals 501 will hook into the wall of the terminal plugholes 601 to be fixed therein after insertion of the terminals 501 of the conductive terminal 50, the tandem piece 502 of the conductive terminal 50 is connected to the LED lamp strip 40 through a transmission line, and the positioning enclosure 60 has, on an inner surface thereof, a circular groove 602 corresponding to the tube wall and the plug track 301 of the transparent tube 30 and also has a plurality of sets of plug track grooves 603, 603*a* (referring to FIG. 10), 604, 604*a* formed at different angles for the plug track 301 of the inner wall of the transparent tube 30 to be selectively plugged therein, thereby achieving the objective of changing the illumination direction of the LED lamp strip 40 of the LED tube 30.

Figure 11:
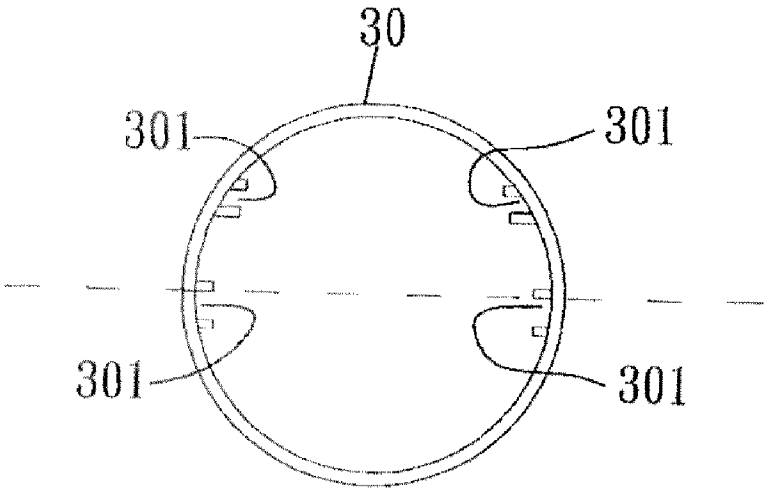
FIG. 11 is a schematic view of another embodiment of the transparent tube of the present invention.

The LED lamp wick 40 (referring to FIG. 8) comprises a bridge rectifier 401. FIG. 11 is a schematic view of another embodiment of the transparent tube of the present invention. As shown in FIG. 11, the transparent tube 30 may also have a plurality of sets of plug tracks 301 positioned at different angles disposed on the inner tube wall thereof for the LED lamp strip 40 to be selectively plugged and positioned therein (reference can be made to FIG. 5).

Figure 12:
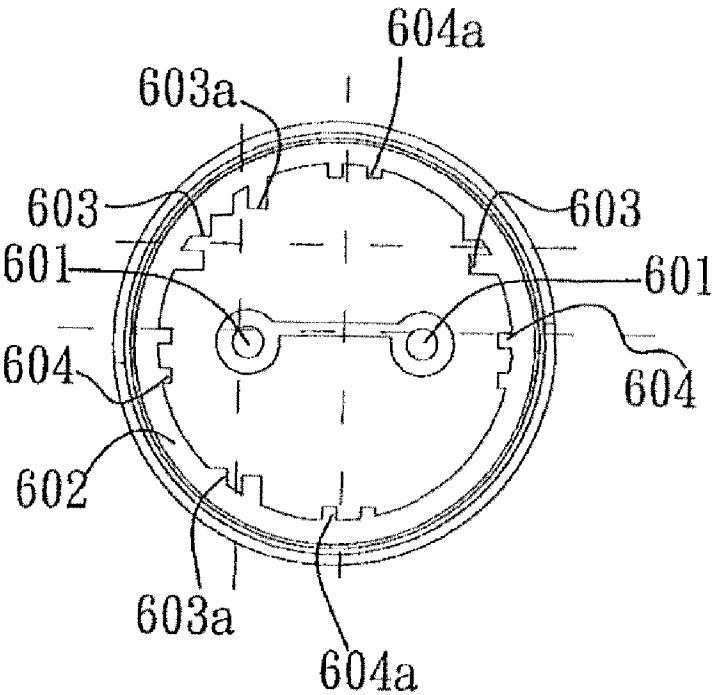
FIG. 12 is a schematic view of another embodiment of the positioning enclosure of the present invention.

FIG. 12 is a schematic view of another embodiment of the positioning enclosure of the present invention. As shown in FIG. 12, the positioning enclosure 60 has a plurality of sets of plug track grooves 603, 603*a*, 604, 604*a* positioned at different angles and a circular groove 602 that correspond to the plug tracks 301 positioned at different heights on the inner tube wall of the transparent tube 30 (referring to FIG. 6, FIG. 7 and FIG. 11), thus forming a universal structure of the positioning enclosure 60. This makes it easy to select one of the plug track grooves 603, 603*a*, 604, 604*a* positioned at different angles and the circular groove 602 for one of the plug tracks 301 disposed at different angles on the inner tube wall of the transparent tube 30 to be plugged therein correspondingly, thereby achieving the objective of changing the illumination direction of the LED lamp strip 40 of the LED tube 30.

According to the above descriptions, the structure of the present invention can indeed achieve the expected objective and has not been published before, so it complies with the essential patent elements of usefulness and novelty. Therefore, the applicant hereby files this patent application with your office according to the Patent Law and earnestly requests the examiners of your office to examine and grant the patent right of this application as early as possible.

It shall be appreciated that, what described above are only preferred embodiments of the present invention. Accordingly, all modifications made within the spirits of the present invention shall still fall within the scope of the present invention.

What is claimed is:

1. An improved LED tube structure capable of changing an illumination direction, being characterized in:

a transparent tube having a corresponding plug track disposed on an inner tube wall thereof, wherein the plug track is disposed on the inner wall of the transparent tube at a height that is approximate to or above a horizontal center line of the transparent tube and the plug track is adapted for an LED lamp strip to be plugged and positioned therein;

a conductive terminal being formed of a metal through stamping and having a tandem piece disposed between two terminals thereof, wherein both the terminals have a plurality of protruding hooks disposed thereon; and a positioning enclosure having two terminal plugholes spaced apart disposed in the middle portion thereof, wherein the protruding hooks of the terminals hook into the wall of the terminal plugholes after insertion of the terminals of the conductive terminal, and the tandem piece of the conductive terminal is connected to the LED lamp strip through a transmission line, and wherein the positioning enclosure has, on an inner surface thereof, a circular groove corresponding to the tube wall and the plug track of the transparent tube and a plurality of sets of plug track grooves disposed at different angles for the plug track of the inner wall of the transparent tube to be selectively plugged therein, thereby achieving the objective of changing the illumination direction of the LED lamp strip of the LED tube.

2. The improved LED tube structure of claim 1, wherein the LED lamp strip comprises a bridge rectifier.

3. The improved LED tube structure of claim 1, wherein the transparent tube also has a plurality of sets of plug tracks positioned at different angles on the inner tube wall thereof for the LED lamp strip to be selectively plugged and positioned therein.

4. The improved LED tube structure of claim 1, wherein the inner surface of the positioning enclosure is formed with a plurality of sets of plug track grooves positioned at different angles and a circular groove that correspond to the plug tracks positioned at different heights on the inner wall of the transparent tube to form a universal positioning enclosure structure, which makes it easy to select one of the plug track grooves and the circular groove positioned at different angles for one of the plug tracks positioned at different heights on the inner wall of the transparent tube to be plugged therein, thereby achieving the objective of changing the illumination direction of the LED lamp strip of the LED tube.

* * * * *